US006012987A

United States Patent [19]

Nation

[11] Patent Number: 6,012,987

[45] Date of Patent: Jan. 11, 2000

[54] RECREATIONAL GAME

[76] Inventor: Ralph Wynyard Nation, P.O. Box 363, Waipukurau, New Zealand

[21] Appl. No.: 08/981,755

[22] PCT Filed: Jun. 26, 1996

[86] PCT No.: PCT/NZ96/00063

§ 371 Date: Dec. 23, 1997

§ 102(e) Date: Dec. 23, 1997

[87] PCT Pub. No.: WO97/01376

PCT Pub. Date: Jan. 16, 1997

[30] Foreign Application Priority Data

Jun. 26, 1995 [NZ] New Zealand ..... 272315

[51] Int. Cl.[7] ..... A63B 69/36

[52] U.S. Cl. ..... 473/156; 473/131; 473/199; 700/92; 273/461; 273/DIG. 26

[58] Field of Search ..... 473/131, 150–158, 473/198–200; 364/410.1, 411.1; 273/DIG. 26, 459, 460, 461

[56] References Cited

U.S. PATENT DOCUMENTS

| | | |
|---|---|---|
| 3,589,732 | 6/1971 | Russell et al. . |
| 4,160,942 | 7/1979 | Lynch et al. . |
| 4,168,115 | 9/1979 | Russell et al. . |
| 4,192,510 | 3/1980 | Miller . |
| 4,343,469 | 8/1982 | Kunita et al. . |
| 4,696,474 | 9/1987 | Tegart . |
| 4,836,551 | 6/1989 | LaSalle . |
| 5,056,791 | 10/1991 | Poillon et al. . |
| 5,102,140 | 4/1992 | Vincent . |
| 5,393,064 | 2/1995 | Beard, III et al. . |

*Primary Examiner*—Valencia Martin-Wallace
*Assistant Examiner*—Mark A Sager
*Attorney, Agent, or Firm*—Klauber & Jackson

[57] ABSTRACT

Apparatus to facilitate the playing of a recreational game. The apparatus includes an electronic surveillance camera (8) and a motion sensor (20) mounted above and focused on a target area (2). The image data generated by the camera (8) and the data generated by the motion sensor (20) is transmitted to a central processing unit. The image of the target area transmitted by the surveillance camera (8) is displayed on the screen of a video monitor. Movement of an object on the target area (2) is detected by the motion sensor (20) and displayed on the monitor screen. The central processing unit includes a library of target area overlays to alter the viewed charateristics of the target area on the monitor screen. Each target area may include a marker surrounded by a spaced apart scoring ring or rings so that a ball lying on the target area can, if it lies within a predetermined area, be allocated a score.

11 Claims, 3 Drawing Sheets

RECREATIONAL GAME

TECHNICAL FIELD OF THE INVENTION

This invention relates to a recreational game and in particular to a form of game which may be played with golf clubs or similar hitting devices and with golf balls or with balls or other objects which can be impelled by a hitting object.

BACKGROUND OF THE INVENTION

Golfers, whether professional, amateur and starting, all require adequate practice in striking a golf ball so the golfer is able to obtain a proficiency depending upon the aspirations of the golfer. It is recognised that actually playing a game of golf on a golf course is not the most efficient manner of improving the ability to play golf and a serious golfer generally visits a golf driving range. Golf driving ranges are very good at allowing the golfer to receive practice in a more-or-less controlled environment, but because of the nature of golf driving ranges they are generally neither recreational nor are they competitive since it is generally not possible for players to organise any form of competition.

Currently a golfer, when using a driving range, aims to land a ball either on or somewhere near a "green" which is often nothing more than a section of the range which is defied by markers. There is little satisfaction in such an action and even less competition and consequently golf driving ranges are often not used for relaxation and enjoyment but generally for the specific purpose of the golfer practising to improve his/her game. Consequently it is considered that golf driving ranges would be more consistently sought out by a golfer if there was a better way of judging the performance of the golfer.

If an clement of competition could be brought into a golf driving range, there would be a strong possibility that more customers would visit the range and use the facilities.

In addition, even when a golf driving range has a target area such as a simulated golf green, because the location and shape of the green is fixed, there is little element of variety available to the golfer and it is apparent that if either the location and or the shape of the simulated green or greens can be readily altered, then this will introduce a diversity into the recreation.

Another disadvantage with known forms of golf driving ranges is that there is little opportunity for competition for an individual player or when more than one player is present. For instance, if an element of competition could be introduced whereby a player would be able to use some form of scoring or if it was possible to simulate a round of golf either individually or against other competitors, then this would encourage more people to use the facilities.

It is further considered that if a game could be standardised so that players at different venues could play a competition and have an equal degree of difficulty against players at other venues, then this could further result in increased usage.

While it is apparent that it is desirable for apparatus to be designed which will modify or vary the current usage of golf driving ranges, it will be apparent that the apparatus and ancillary facilities should be able to be utilised in a number of different applications. Consequently the apparatus should be sufficiently flexible in its design and operation that it is possible for any ball or other object to be hit or thrown, to a distance target area and for the results to be calculated and displayed.

OBJECT OF THE INVENTION

It is accordingly an object of this invention to provide an apparatus and associated facilities whereby a recreational game can be played which will go some way towards meeting the above desiderata or at least provide the public with a useful choice.

In the following description, the term 'golf ball' or 'ball' is intended to represent any form of object that can be suitably impelled either by being hit by a golf club or by being hit with any other appropriate form of implement, or by being manually or mechanically thrown.

SUMMARY OF THE INVENTION

Accordingly one form of the invention may be said to comprise apparatus for facilitating the playing of a recreational game, said apparatus consisting of:

- a surveillance camera capable of detecting the presence of an object on the target area,
- means to detect and record the movement of an object on the target area,
- means to display the target area and the position of an object lying on the target area on the screen of a video monitor remote from the target area,
- means to display movement of an object on the target area on the screen of said video monitor,
- means to maintain details of a target overlay which can be displayed on the screen of the said video monitor to alter the characteristics of the target area, and
- means to enable a score to be allocated to an object lying on the target area.

Preferably the means to maintain details of the target area, the means to display movement of an object on the target area and the display of image data generated by the surveillance camera are controlled by a programmed data processor.

Preferably the target overlay comprises a contour line which overlays the image of the target area being displayed on the screen of the video monitor.

Preferably details of a number of target areas are stored in a library accessed by the said data processor.

Preferably each target area and/or each target overlay is allocated a degree of difficulty factor which is utilised by the data processor in the calculation of the score obtained by an object lying on the target area.

Preferably the means to detect and record the movement of an object on the target area comprises a motion sensor.

Preferably the apparatus includes means to process data from the surveillance camera to identify the position of an object lying on the target area relative to a defined location on the target area.

Preferably the data processor identifies the relative position of each object lying on the target area and calculates a score to be allocated to each said object.

Preferably the data processor calculates and retains the scores of different players.

Preferably the target area simulates the shape of a golf green.

Preferably the said object is a ball.

BRIEF DESCRIPTION OF THE DRAWINGS

Preferred forms of the invention will now be described with the aid of the accompanying drawings wherein.

DESCRIPTION OF THE PREFERRED EMBODIMENTS

Figure 1:
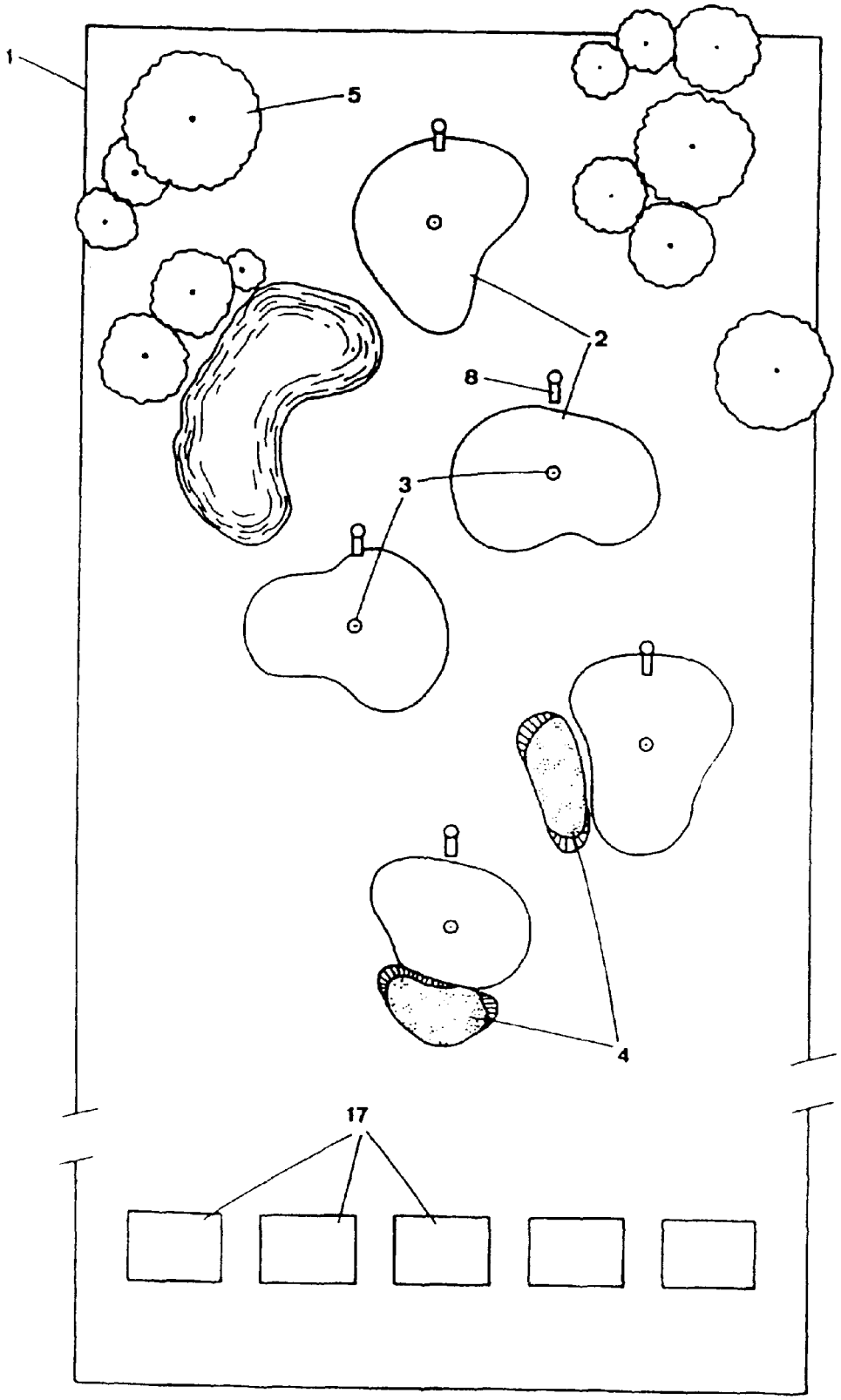
FIG. 1 is a view of a typical area layout using the teachings of this invention.

As can be seen from FIG. 1, a playing area can be located within a defined zone 1 and can have a number of permanent target areas 2, each of which can have a predetermined shape and size. Each target area may be provided with a marker stick 3 and may have an area of difficulty such as a "bunker" 4 or other hazard. The playing area may also be provided with trees or shrubs such as those indicated at 5 to assist the aesthetic quality of the playing area.

Figure 2A:
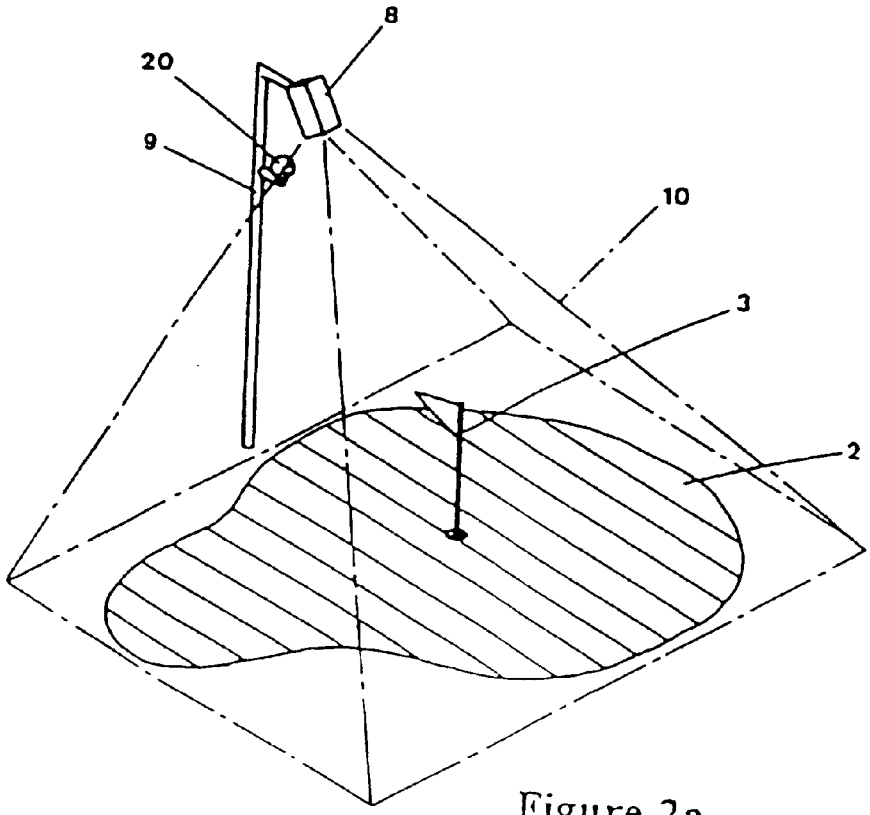
FIGS. 2*a* and 2*b* are diagrammatic views of two typical target areas together with a surveillance camera and motion detector.
Figure 2B:
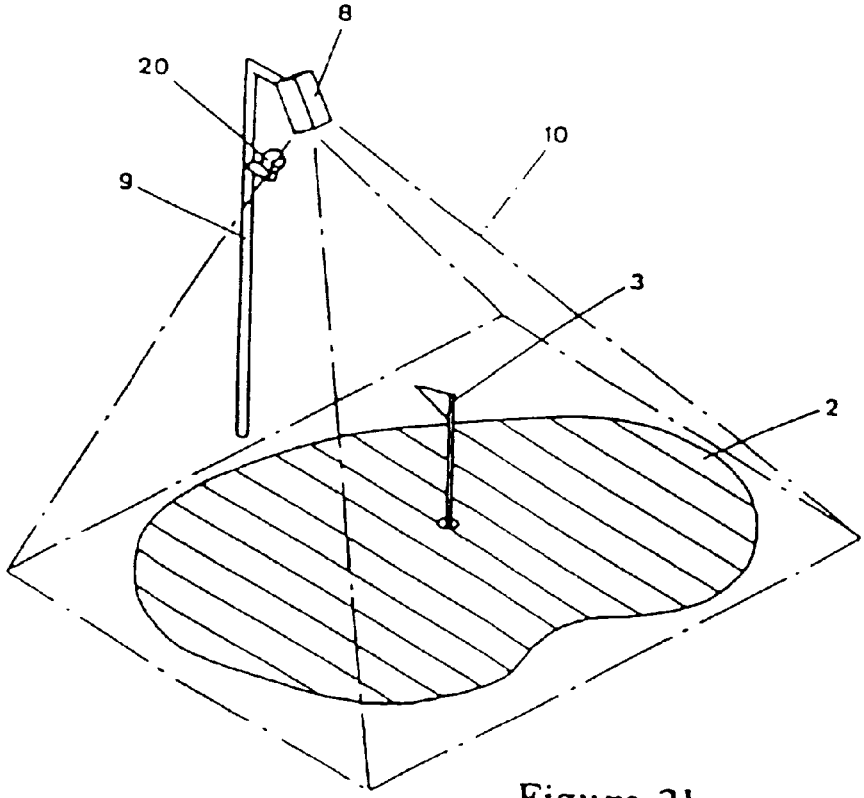

Each target area 2 is provided with a surveillance camera 8 (see particularly FIGS. 2*a* and 2*b*) which may be a video camera of a known type and which is suitably mounted such as on a pole 9, so the lens of the camera is raised above the target area a sufficient amount that the field of vision 10 of the camera will embrace preferably all of the target area. The camera 8 will generally be supported at a height that will substantially protect it from vandalism and/or theft and it may be provided with suitable shields or the like to protect it from damage by balls and other objects. It has been found that a suitable height can be up to eight metres above the target area.

Cabling (not shown in the drawings) extends from each surveillance camera and is terminated at a data processing station. Preferably the cabling is led underground or is otherwise protected from damage and vandalism.

Particularly if more than one player is shooting at the same target area, because the surveillance camera must be mounted at a substantial height, it is not generally possible for the identity of different balls to be ascertained on the monitor screen because of the small nature of the ball in relation to the size of the vision area. While various means capable of identifying each ball are available, in a highly preferred form, the identification is arranged by means of the motion detector which will detect a moving ball on the target area. In one form a motion detector means 20 may be mounted on the same pole 9 as the surveillance camera 8 and has a field of vision that approximately equates to the field of vision 10 of the surveillance camera 8. In a highly preferred form, the data from the surveillance camera is fed into a motion detector connected to the data processor, the output of which modulates the image displayed on the screen of the monitor to indicate the movement of the ball. In one form this indication can for instance be a trace or other ready identification as will be known in the art. This trace can remain on the screen until it is removed either manually by pressing an appropriate control or automatically when for instance the next ball is hit. Although there are other methods of tracing the arrival of balls onto a target area, it is highly desirable that the direction from which the ball has arrived can also be displayed and it has been found that these requirements are adequately met by the combination of the motion detector referred to above and appropriate software.

The data processing centre is capable of continuously receiving and if necessary storing the electronic information from the camera and from the motion detector or ball identification means. In a highly preferred form, the information is ransmiuted from the data processing centre to a video monitor screen 11 (see FIG. 3) located adjacent the player so the player is able to see from the monitor screen where the ball or balls are lying on the target area and will also be able to identify the trace or other display generated by the motion detector means as the ball arrives on the target area 13.

Preferably the monitor screen also displays a series of scoring rings 12 which may be concentric with the marker stick 3. The scoring rings can be designated with a predetermined scoring ability. For instance if the target area is being utilised for a game of golf, then the inner scoring ring can signify a score of two under the designated number of strokes for the hole (an 'eagle'). The second scoring ring can designate a score of one under the designated number of strokes for the hole (a 'birdie') and the outermost ring can signify an equal score to the designated number of strokes for the hole (a 'par'). Generally the rings 12 will be circular but they can be of any desired contour. An additional scoring ring can also be incorporated for instance on the target area so that it is possible to signify a score of one over the designated number of strokes for the hole (a 'bogie'). Even further scoring rings can be incorporated if desired to signify other scoring methods or results.

Figure 3:
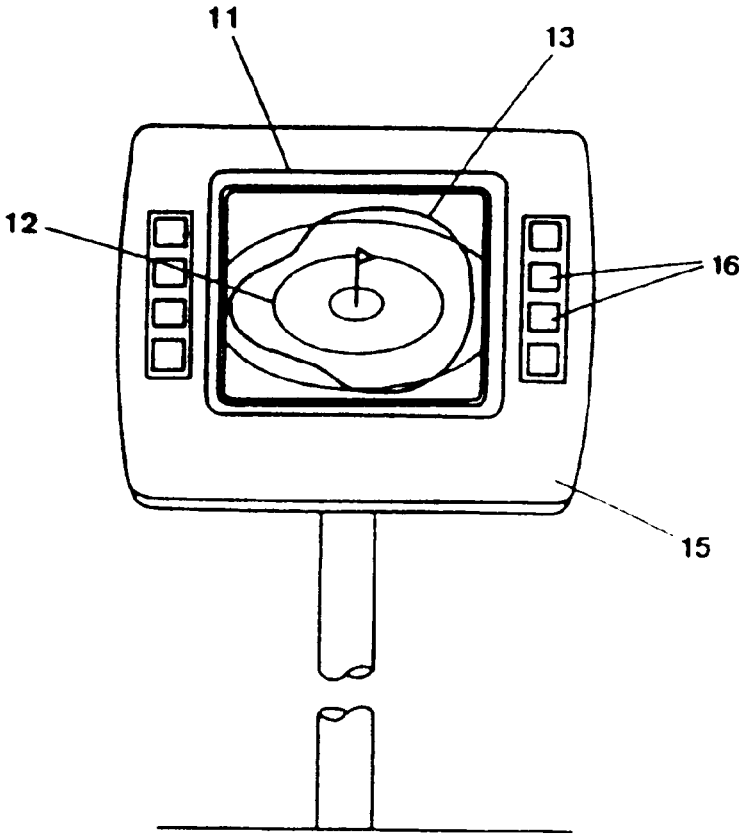
FIG. 3 is a diagrammatic view of a typical video monitor displaying a simulated target area on the screen.
Figure 4A:
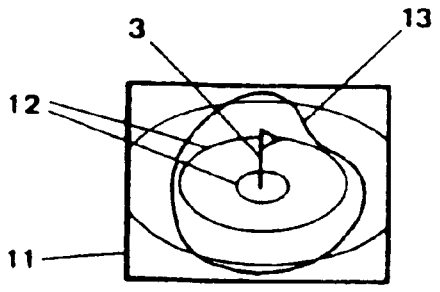
FIGS. 4*a* and 4*b* are diagrammatic views of two layouts of simulated target areas that can be displayed on the monitor screen.
Figure 4B:
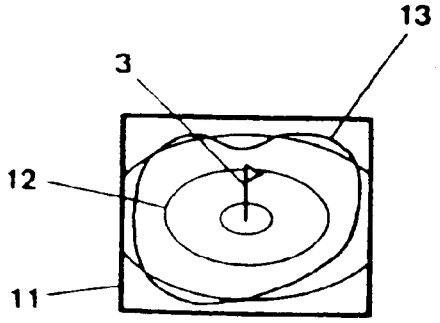

As indicated in FIGS. 3, 4*a* and 4*b*, the monitor screen 11 also displays a target overlay 13 which reflects a shape of the selected target area from a data base library and such target overlay can encompass part or all of the scoring rings 12 as indicated in FIGS. 4*a* and 4*b*. Consequently, dependent upon the target overlay 13 selected, it is possible that a ball can lie on an actual target area within the scoring zone defined by the scoring rings, but because it is lying outside the contour displayed by the target overlay, the ball will not score.

Different target overlays 13 can also have different scoring values depending upon the degree of difficulty. If there is more than one actual target area 2, then depending upon the actual location of the target area in regard to the teeing off area, the target area that is furthest away can have a difficulty factor which is multiplied by the overlay factor.

In a modification, the data processing system is capable not only of displaying the location of a ball or balls on the monitor 15 but also of determining the relative positions of the ball to the marker stick 3 and can therefore calculate the score of each ball lying on the actual target area. The score can be displayed either on the screen of the video monitor or can be displayed such as in the panels 16. In this modification, the score of each player can be stored by the data processor and the relative and final state of the game can be displayed on the monitor.

In a yet further modification, the system is able to be set so the data processor can not only identify the relative positions of the balls on the target area but can also distinguish which ball belongs to which player and therefore can allocate points to each player depending upon the result.

In a still further modification, the system is able to store the information concerning the scores of any player which can be recalled when required so that a competition that can extend over a period of time can be run.

Because of the capabilities of the data processor and of the software which controls the operation of the data processor, a very wide variety of target areas can be stored in the library of the data processor and the target overlay of any of these target areas can be simply recalled as required. It is therefore possible to change the degree of difficulty of each target area merely by selecting an appropriate target overlay on the monitor.

It is envisaged that the course layout will be standardised so that a player can play on different venues and be able to play essentially the same course. This aspect can be of considerable benefit in that competitions between players at different venues can be run.

Similarly because of the capability of storing information both of the scores of any player or players and of the ability to recall a large variety of simulated target areas, competitions that can carry over from one game to another can be run because of the possibility of setting up a course with a consistent layout.

In one form of the game when played as a golf game, particularly if it is intended there be competition between two or more players, the order of the target areas 2 which are to be played is decided. The next step is to decide which of the target areas from the library is to be chosen so as to create and display overlay targets for each target area. When these items are agreed, the player who has the 'honour' hits off first from a teeing off position such as that indicated at 17. When all the players have completed the hole, the scores are stored such as by writing on a card or if the monitor includes the necessary facility by punching in the score in a terminal on the monitor. It will also be understood that the data processor can be programmed to store the scores, sort the total scores into an order of merit and display the results on the video monitor. In a modification, the data processor can be programmed to send the results to a suitable printer to automatically print the scores and the results.

It is possible for various forms of competition to be run when using the game according to the foregoing description. For instance each player can hit an agreed number of balls onto a target area and the combined score of all the balls will provide the result for each player. Because of the ability to use different target overlays for each target area, it is possible to include a form of handicapping into any of the methods of competition. For instance, in another method of competition, one player can play to an agreed actual target area 2 and the other player(s) can play to the same target area but use a different target overlay 13 so the degree of difficulty between the players can be altered. In a yet further form of competition, one player can play to a specific target area 2 and the other player(s) can play to another target area 2. In a still further form of competition, all players can hit a ball or balls successively onto more than one target area and the results can be decided either by a form of match play or stroke play.

Another form of competition that can be carried out when using the apparatus of the present invention is a competition comprising a round of golf which can consist of any number of holes up to the recognised number of eighteen. In this form of competition, the round of golf can consist of a number of par three, par four and par five holes and preferably the details of these holes, that is the type of hole, the length of the hole and the degree of difficulty are imprinted on a card to simulate a card of the usual known form of golf course. In the case of a par three hole, the player will be expected to hit the ball a sufficient distance to reach the target area and therefore prior to hitting the ball the player will have selected the type of target area from the library kept in the system which will equate to the length and type of a 'hole' either that is displayed on the score card, or which has been agreed between the players. The players will then hit a ball from the "tee" position 17 in the agreed order.

To ensure accuracy of the hit, means (not shown on the drawings) can be employed to indicate out of bounds markers which can be either mechanical or electronic so that a ball which is hit wide off the tee position 17 outside a predetermined boundary will be identified an the data sent to the data processor so an appropriate penalty can be levied.

In the case of holes such as par four and par five, the simulated fairway can be arranged and means can be included so that the distance of the drive from the tee can be identified and calculated. For instance if a par four hole has a length of 350 metres, the player will first drive from the tee and provided the ball safely lands on a simulated fairway, the system will indicate the distance driven and the distance to the green. Preferably the system is set so that on a par four hole, the player is expected either to reach the target area in two shots, or else reach the approach to the target area in two shots. To attain this, the system can be set so that after the first shot, the system will calculate the distance covered by the ball from the teeing off area and then will automatically display a target area that is the closest in distance to the distance remaining from where the ball has come to rest and the distance to the target area selected from the score card. The player will then hit the next shot and if the player's ball does not land on the target area then depending on the distance from the target area, the system will display a target area that equates approximately to the distance that the ball still had to travel after the second shot. The player can then play the third shot and if that ball lands on the target area, it will be recorded by the motion detector means and by the surveillance camera.

A similar arrangement can also be utilised for a par five hole and it will be understood that for this purpose the software will be set so that an appropriate target area will selected for each length of hole. Consequently, one or more players can play a simulated round of golf with actual clubs and golf balls and the results can be manually printed on the score card, and/or automatically printed by the system.

It will be understood that various means of locating a ball after it has been hit from the tee and/or during flight can be utilised as will be apparent to those skilled in the art. For instance apparatus can be produced which will utilise the global positioning system, or the flight, the landing position and final resting position can by located by any of the known 'radar' techniques.

In its simplest form, the monitor will display the actual target area, the target overlay and the scoring rings including the score value of each scoring ring. The value of the score is then calculated by reference to a chart or the like which will provide a multiplication factor for the particular target overlay used and from this the score for the hole of each player can be calculated. It will be understood that in a highly preferred form of the invention, these calculations will be carried out automatically by the data processing centre.

In a further modification, the display monitor can have means so that a selected area of the displayed target area together with the scoring lines and where applicable the contour line delineating the target overlay can be enlarged to assist the determination and/or the calculation of the score to be awarded to any particular ball or balls. It will also be understood that the display monitor can be in the form of a 'touch screen' so that the various functions required of the software and the visual display can be arranged by touching the screen at the appropriate location.

While the above description relates to a preferred embodiment of the invention it is to be understood that alterations and modifications may be made to the preferred form of the invention as will be apparent to those skilled in the art and/or such modifications and amendments are intended to be included within die scope of the present invention as defined in the appended claims.

I claim:

1. Apparatus for facilitating the playing of a recreational game, said apparatus consisting of:

a surveillance camera capable of detecting the presence of an object on the target area, means to detect and record the movement of an object on the target area, means to display the target area and the position of an object lying on the target area on the screen of a video monitor remote from the target area, means to display movement of an object on the target area on the screen of said video monitor, means to alter details of a target overlay which can be displayed on the screen of the said video monitor to alter the characteristics of the target area, and means to enable a score to be allocated to an object lying on the target area.

2. The apparatus as claimed in claim 1, wherein the means to maintain details of the target area, the means to display movement of an object on the target area and the display of image data generated by the surveillance camera are controlled by a programmned data processor.

3. The apparatus as claimed in claim 2, wherein the target overlay comprises a contour line which overlays the image of the target area being displayed on the screen of the monitor.

4. The apparatus as claimed in claim 2, wherein details of a number of target areas are stored in a library accessed by the said data processor.

5. The apparatus as claimed in claim 2, wherein each target area and/or each target overlay is allocated a degree of difficulty factor which is utilised in the calculation of the score obtained by an object lying on the target area.

6. The apparatus as claimed in claim 1, wherein the means to detect the arrival of a ball on the target area comprises a motion sensor.

7. The apparatus as claimed in claim 6, including means to process data from the surveillance camera to identify the position of an object lying on the target area relative to a defined location on the target area.

8. The apparatus as claimed in claim 2, wherein the data processor identifies the relative position of each object lying on the target area and calculates a score to be allocated to each said object.

9. The apparatus as claimed in claim 2, wherein the data processor calculates and retains the scores of different players.

10. The apparatus as claimed in claim 1, wherein the object said object is a ball.

11. The apparatus as claimed in claim 1, wherein the target area simulate the shape of a golf green.

* * * * *